United States Patent [19]

Celeste

[11] 4,073,384

[45] Feb. 14, 1978

[54] SHELF PROTECTOR

[76] Inventor: Lawrence S. Celeste, 1561 Birch, Hanover Park, Ill. 60103

[21] Appl. No.: 683,837

[22] Filed: May 6, 1976

[51] Int. Cl.[2] ..... A47F 5/00

[52] U.S. Cl. ..... 211/134; 211/49 R

[58] Field of Search ..... 108/13, 27, 32, 90; 211/49 R, 49 D, 90, 134, 135, 153; 312/140.3, 140.4

[56] References Cited

U.S. PATENT DOCUMENTS

| | | | |
|---|---|---|---|
| 1,170,268 | 2/1916 | Hurley | 108/27 X |
| 2,492,541 | 12/1949 | Stanitz | 108/27 |
| 2,789,874 | 4/1957 | Hammer | 108/27 |
| 2,970,872 | 2/1961 | Ullman, Jr. | 108/27 |
| 3,085,693 | 4/1963 | Shell | 211/134 |
| 3,394,818 | 7/1968 | Fineberg et al. | 211/49 R X |

FOREIGN PATENT DOCUMENTS

| | | | |
|---|---|---|---|
| 719,619 | 10/1965 | Canada | 108/27 |
| 755,945 | 4/1967 | Canada | 211/134 |
| 712,900 | 7/1965 | Canada | 211/49 D |
| 449,681 | 7/1936 | United Kingdom | 211/135 |

*Primary Examiner*—Roy D. Frazier
*Assistant Examiner*—Terrell P. Lewis
*Attorney, Agent, or Firm*—Hill, Gross, Simpson, Van Santen, Steadman, Chiara & Simpson

[57] ABSTRACT

A protective shelf assembly which has a removable sheet-like shelf protector positioned over a shelf structure such as a wedge-shaped shelf installed on a supporting member. A lip of the shelf protector overhangs and abuts against a front edge of the shelf. A removable sheet-like shelf back protector is also provided which is positioned to lie against a shelf back member which is perpendicular to a rear edge of the shelf surface. As the shelf protectors become scratched, dented or otherwise damaged by products being displayed, the shelf protectors are discarded and replaced by new ones.

6 Claims, 7 Drawing Figures

Fig. 1
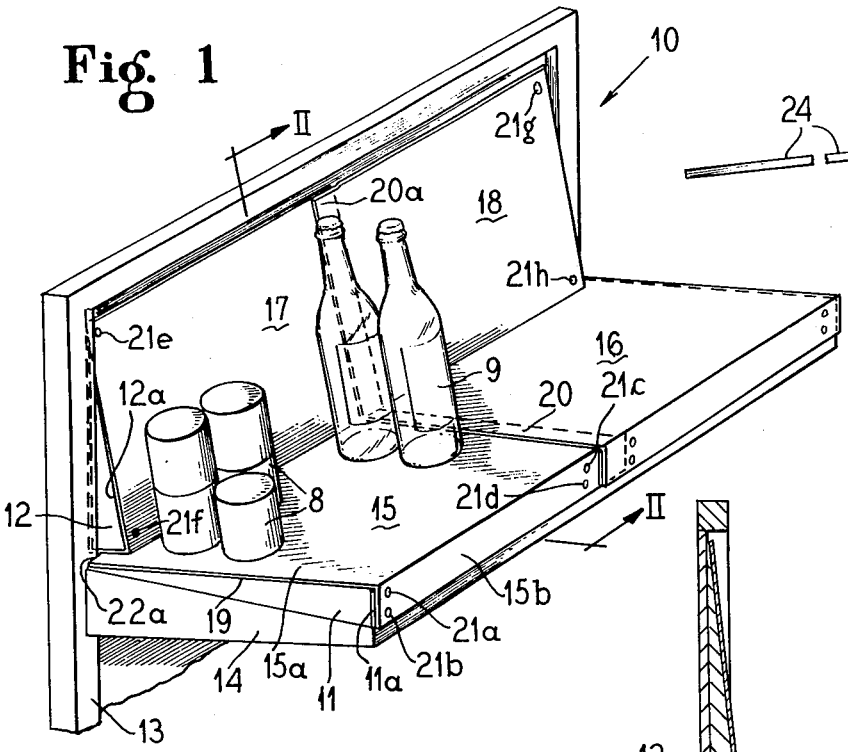
Fig. 6
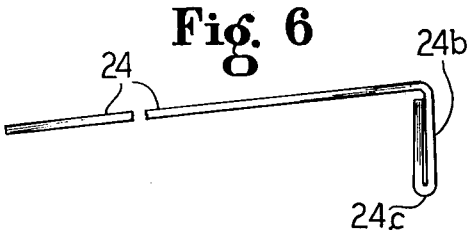
Fig. 5
Fig. 2
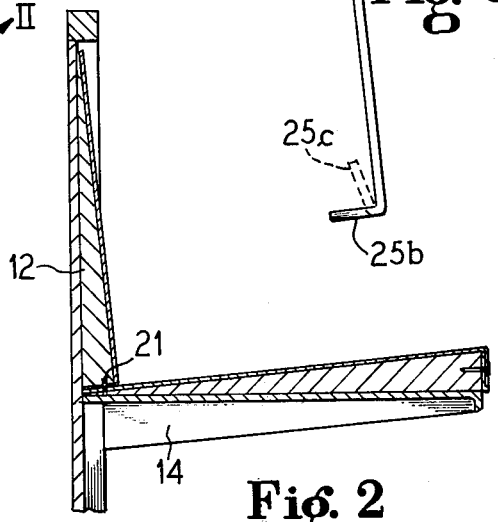
Fig. 3
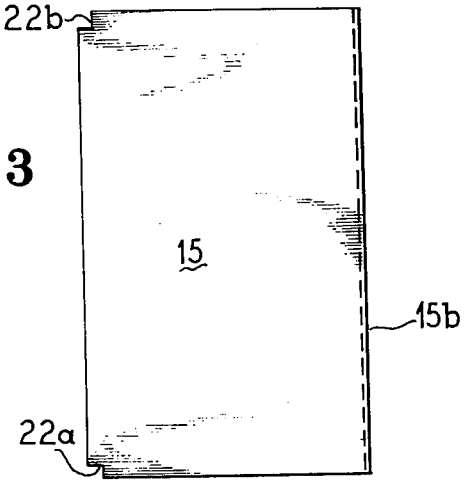
Fig. 4
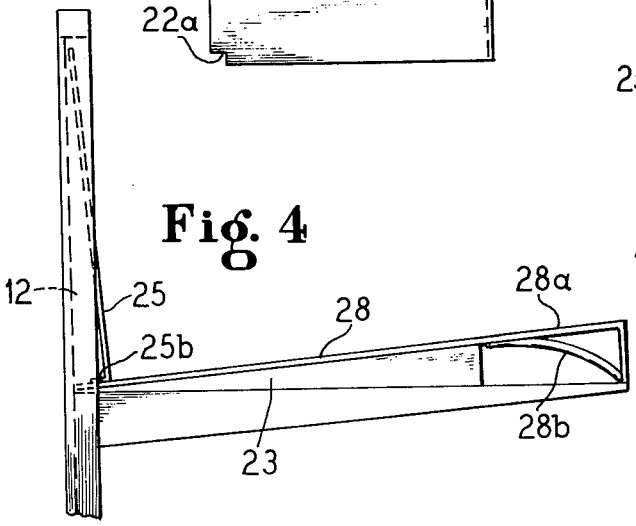
Fig. 7
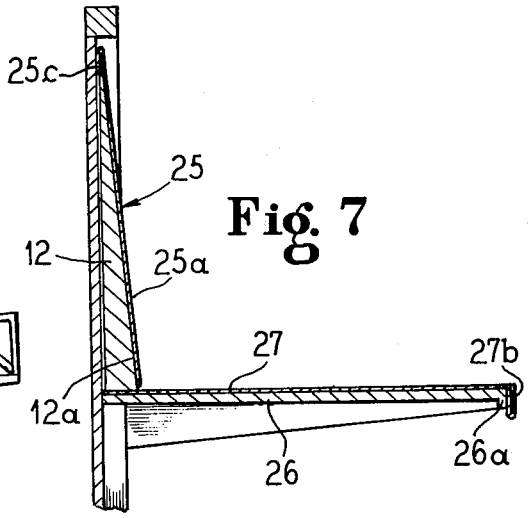

SHELF PROTECTOR

BACKGROUND OF THE INVENTION

1. Field of the Invention

This invention relates to protective shelf assemblies and more particularly to removable sheet-like shelf protectors.

2. Description of the Prior Art

Various shaped shelves, including wedge-shaped shelves, are known to provide a tilted shelf surface for the display of glass bottled or canned products such as soft drinks. Since the shelf surfaces are typically tilted rearward, products being displayed are pulled by gravity toward the back edge of the shelf. A wedge-shaped shelf back may be positioned at a rear edge of the shelf to provide a backing against which the products being displayed may rest.

Bottles or cans have sharp corners and hard surfaces which scratch and dent surfaces of display shelves during stocking operations. Replacement of shelf and shelf backs is very expensive and time-consuming.

SUMMARY OF THE INVENTION

It is an object of this invention to minimize the expense and labor required for repairing product display shelves.

It is a further object of this invention to provide removable shelf and shelf back protectors which may be simply replaced with new protectors when the original shelves or shelf backs have been seriously damaged.

According to the invention, a protected shelf assembly has removable sheet-like shelf protectors which are positioned on the surface of a shelf, such as a wedge-shaped shelf. A lip of the shelf protector overhangs and abuts against the front edge wall of the shelf. A removable sheet-like shelf back protector is also provided which is positioned to lie against the back surface of the shelf. Protectors may be aligned adjacent one another along the running length of the shelf surface and side edges of the protectors may overlap to provide a continuous surface. As the shelf and shelf back protectors become damaged, they are removed and replaced with new protectors.

BRIEF DESCRIPTION OF THE DRAWINGS

FIG. 1 is a perspective view of the protected shelf assembly of this invention;

FIG. 2 is a cross-sectional view taken along line II—II of FIG. 1;

FIG. 3 is a plan view of the removable shelf protector of this invention;

FIG. 4 is a side view of an alternate embodiment for the protector shelf assembly of this invention;

FIG. 5 is a side view of an alternate embodiment for the shelf back protector of this invention;

FIG. 6 is a side view of an alternate embodiment for the shelf protector of this invention; and FIG. 7 is a side view of an alternate embodiment for a protected shelf of this invention.

DESCRIPTION OF THE PREFERRED EMBODIMENTS

A protected shelf and back assembly of this invention is generally shown at 10 in FIG. 1. A wedge-shaped shelf 11 is supported by a shelf support 14 connected to one or more uprights or supporting posts 13. A shelf surface 19 extends rearwardly from a lead edge 11*a* at an angle less than 90°. Canned products 8 or bottled products 9 are displayed on the tilted shelf surface 19. Cans and bottles 8 and 9 lie against back surface 12*a* of the shelf back 12. Supporting pin or pins 21, most clearly shown in FIG. 2, connect the shelf back 12 to the shelf 11 at the rear edge of the shelf adjacent the supporting post 13.

One or more sheet-like shelf protectors 15 and 16 are arranged on the shelf surface 19. The protectors may be positioned to overlap at 20 along abutting side edges thereof. Shelf back protectors 17 and 18 are positioned against the shelf back surface 12*a*. These protectors may also have side edges thereof which overlap such as at 20*a*. The shelf protector 15 has a main surface portion 15*a* which abuts directly against shelf surface 19. A lip portion 15*b* formed at right angles to the main surface 15*a* overhangs and abuts the leading edge 11*a* of the shelf 11. Fastening means such as screws 21*a,b,c,d* may be employed to fasten the shelf protectors 15 or 16 to the shelf leading edge 11*a*. Fastening means such as screws 21*e,f,g,h* may be employed at corners of the shelf back protectors 17 or 18 to fasten to the shelf back surface 12*a*.

As most clearly shown in FIG. 3, cut-out portions 22*a* or 22*b* may be provided along the rear edge of the shelf protector 15 for abutting against post or posts 13.

As the cans 8 or bottles 9 are continually shifted on the surface of the shelf protectors 15 or 16, dents and scratches occur in the shelf protectors. To recondition the shelves, the shelf protectors 15 or 16 and shelf back protectors 17 or 18 are removed and replaced with new protectors. Since the protectors are preferably constructed of an inexpensive metal or other suitable material such as plastic with minimum thickness, large savings result by replacement of protectors rather than the entire shelf structure.

Another embodiment for the shelf protector is shown in FIG. 4. In FIG. 4 a shelf protector 28 is illustrated which has an extended portion 28*a* reinforced with a curved element 28*b*.

Alternate embodiments for various elements of the protected shelf assembly of this invention are illustrated in FIGS. 4, 5, 6 and 7. As shown in FIG. 5, a back protector 25 may have a lip 25*b* or 25*c*. The lip 25*b* may be positioned between wedge-shaped back 12 and shelf 23 as in FIG. 4 or the lip 25*c* may be used to hang the protector 25 from the top end of the shelf back 12 so that the back protector surface portion 25*a* lies against the back surface 12*a*.

An alternate embodiment for the shelf protector is indicated at 24 in FIG. 6. Shelf protector 24 is provided with a double thickness lip portion 24*b* created by bending back additional material at bend 24*c*.

The shelf protectors of this invention are equally well suited for use with alternate types of shelving such as shown in FIG. 7. A flat shelf 26 is shown having shelf protector 27 arranged thereon. A lip 27*b* of the shelf protector 27 overhangs edge 26*a* of the shelf 26.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A protected shelf assembly comprising in combination:

a. a shelf securely installed on a supporting means and a shelf back secured at approximately right angles to said shelf at an interior edge adjacent said supporting means;

b. a removable shelf protector having a sheet-like main surface portion and a lip, the main surface portion being positioned on a surface of said shelf and the lip portion abutting an outer edge of said shelf remote from said supporting means;

c. a sheet-like shelf back protector having a main surface portion which is positioned against a surface of said shelf back;

d. said shelf back and shelf having wedge-shaped display surfaces and said shelf protector is of a complementary wedge shape; and e. a plurality of said shelf protectors and shelf back protectors being provided so that at least two adjacent protectors overlap along side edges thereof.

2. A protected shelf assembly comprising in combination:

a. a substantially horizontal shelf support and a substantially vertical shelf back support;

b. a shelf disposed on said horizontal shelf support and a shelf back disposed against said shelf back support, said shelf having a display surface and a substantially vertical edge wall outwardly of said shelf back;

c. a removable shelf protector having a continuous sheet-like main surface portion substantially covering all of the shelf display surface, and a lip portion forming an angle of substantially 90° with said main surface portion which overlies said shelf edge wall so that said shelf protector has a complementary shape to said shelf display surface and edge wall;

d. a removable shelf back protector having a continuous sheet-like main surface portion substantially covering a back surface of the shelf back;

e. easily removable shaft-like attachment members securing the removable shelf and shelf back protectors to the shelf and shelf back; and f. a plurality of said shelf protectors and shelf back protectors being provided so that at least two adjacent protectors overlap along side edges thereof.

3. A protected shelf assembly as defined in claim 2 wherein said shelf is wedge-shaped and has a tilting display surface and said removable shelf protector has a complementary shape to said wedge-shaped shelf display surface.

4. A protected shelf assembly as defined in claim 2 wherein said shelf back is wedge-shaped and said removable shelf back protector has a complementary shape to said wedge-shaped shelf back.

5. A protected shelf assembly as defined in claim 2 wherein said shelf back protector includes a lip along the lower edge thereof for contact with said shelf protector.

6. A protected shelf assembly as defined in claim 2 wherein said shelf back protector includes a lip along an upper edge thereof so as to support said shelf back protector on a top end of said shelf back.

* * * * *